US006142073A

United States Patent [19]

Zeman et al.

[11] Patent Number: 6,142,073

[45] Date of Patent: Nov. 7, 2000

[54] METHOD AND APPARATUS FOR EXCHANGING A ROLL OF A PRINTING PRESS

[75] Inventors: Dale E. Zeman, Denmark; William J. Van Ryzin; Robert J. Manders, both of DePere; Craig T. Compton, Green Bay, all of Wis.

[73] Assignee: Paper Converting Maching Company, Green Bay, Wis.

[21] Appl. No.: 09/378,021

[22] Filed: Aug. 20, 1999

[51] Int. Cl.[7] ..... B41F 5/00

[52] U.S. Cl. ..... 101/216; 101/477; 101/485

[58] Field of Search ..... 101/477, 216, 101/217, 218, 219, 485, 375, 352.01, 247

[56] References Cited

U.S. PATENT DOCUMENTS

| | | | |
|---|---|---|---|
| 5,188,027 | 2/1993 | Fantoni | 101/216 |
| 5,241,905 | 9/1993 | Guaraldi et al. | 101/216 |
| 5,370,047 | 12/1994 | Compton . | |
| 5,394,797 | 3/1995 | Döbler et al. | 101/216 |
| 5,398,604 | 3/1995 | Burke et al. | 101/216 |
| 5,461,978 | 10/1995 | Chou | 101/216 |
| 5,481,972 | 1/1996 | Schmid | 101/216 |
| 5,549,044 | 8/1996 | Achelpohl | 101/216 |
| 5,638,754 | 6/1997 | Steinmeler et al. | 101/447 |
| 5,651,312 | 7/1997 | Borghesan | 101/216 |
| 5,813,336 | 9/1998 | Guaraldi et al. | 101/218 |
| 5,906,162 | 5/1999 | Kolbe, et al. . | |
| 5,974,968 | 11/1999 | Achelpohl et al. . | |
| 6,019,038 | 2/2000 | Kusunoki et al. | 101/216 |

OTHER PUBLICATIONS

Novoflex Brochure Published by Windmoller & Holscher.
Color copy of p. 12 of Novoflex Brochure.
Converting Today, Dec. 1996.
Flexo & Gravure International, Feb. 1998.

*Primary Examiner*—Eugene Eickholt

[57] ABSTRACT

A side shift mechanism for a deck of a printing press enables a roll, for example, a plate roll and/or an anilox roll, to be shifted axially so that one end of the roll extends out of the frame of the press. The extended roll or a sleeve on the roll is thereby made accessible for easy exchange. After the roll or sleeve is exchanged, the roll is shifted back to its original position.

15 Claims, 10 Drawing Sheets

METHOD AND APPARATUS FOR EXCHANGING A ROLL OF A PRINTING PRESS

BACKGROUND OF THE INVENTION

This invention relates to printing presses, and, more particularly, a method and apparatus for exchanging the rolls of a printing press.

Printing presses such as flexographic presses include one or more decks for supporting rolls adjacent a central impression (CI) drum or cylinder. For example, a flexographic press typically includes multiple color decks, and each color deck includes a plate roll and an anilox roll. The anilox roll transfers ink from an ink fountain or doctor chamber to the plate roll. The plate roll carries the print image and imprints the image onto a web which is supported by the central impression (CI) drum.

The plate roll and anilox roll of certain designs of flexographic presses comprise a mandrel and a sleeve which is removably mounted on the mandrel. The outer surface of the sleeve of the plate roll carries the print image. The outer surface of the sleeve of the anilox roll is coated with ceramic and is engraved for controlled pick up of ink and transfer of ink to the plate roll.

In some flexographic presses, both ends of the plate and anilox rolls are supported in bearings on the front and back frames of the press. In order to exchange a roll or the sleeve of a roll, the front bearing or bearing housing is removed from the front end of the roll, and the back end of the roll is supported as a cantilever in the back bearing. However, the front end of the roll is inside of the front frame, and the operator must reach into the frame to remove the roll or to remove the sleeve of a roll. Two problems are thereby presented—potential operator injury and potential damage to the outer surface of the roll.

The space between the OD (outside diameter) of the roll (plate or anilox) and the machine framework is generally close. Typical clearances for maximum roll diameters are less than ¼ inch. The operator's hands must reach for the roll and pull outward. This can cause his hands to bump the machine framework or pinch between the roll and the machine framework.

Roll damage occurs most often when inserting a sleeve onto an empty mandrel. The surface of the sleeve bumps and/or rubs on the machine before it is placed on and then guided by the mandrel. The surface of the plate roll sleeve carries the print image and is therefore susceptible to damage. This leads to expensive machine downtime. The surface of the anilox sleeve is coated with ceramic and engraved. If the ceramic surface gets even minor chips, the roll must be coated and engraved again.

Another problem with the present art is the bearing cap. The mandrel (or roll journal) must be supported in a bearing cap (or housing) on both ends. The present art has these caps automated to open or release the mandrel. This automation adds cost to the machine. Automation also requires compliance, which reduces stiffness. The reduced stiffness leads to print bounce problems.

In other designs of flexographic presses, only one end of the plate roll and the anilox roll is supported by a bearing during printing. The rolls are therefore cantilevered both while the press is running and while exchanging rolls or sleeves. The problem with machines in which the rolls are cantilevered during running is poor stiffness. The intermittent loading from the printing nip cannot be handled adequately by a mandrel supported only on one end. On a typical flexographic printing press having a width from 29 inches to 65 inches, the print speed would be greatly reduced to avoid print skipping problems.

SUMMARY OF THE INVENTION

In accordance with the invention, the plate and anilox rolls are supported on both ends during the printing operation. At the time of roll exchange, the front end of the roll is shifted axially out of the front bearing, and the roll is cantilevered on the back bearing. The front bearing is shifted out of the way, and the cantilevered roll is shifted axially forwardly so that the front end of the roll extends outside of the front frame. The operator then has adequate free space to grasp the front end of the roll or sleeve to remove it. When a new sleeve is installed, the front end of the mandrel extends out of the front frame and guides the sleeve into the machine to avoid costly damage to the surface of the sleeve.

DESCRIPTION OF THE DRAWING

The invention will be explained in conjunction with an illustrative embodiment shown in the accompanying drawing, in which.

DESCRIPTION OF SPECIFIC EMBODIMENT

The invention will be explained in conjunction with a flexographic printing press which includes multiple print decks. However, it will be understood that the invention can also be used with other types of presses and can be used on presses which have only one print deck.

Figure 1:
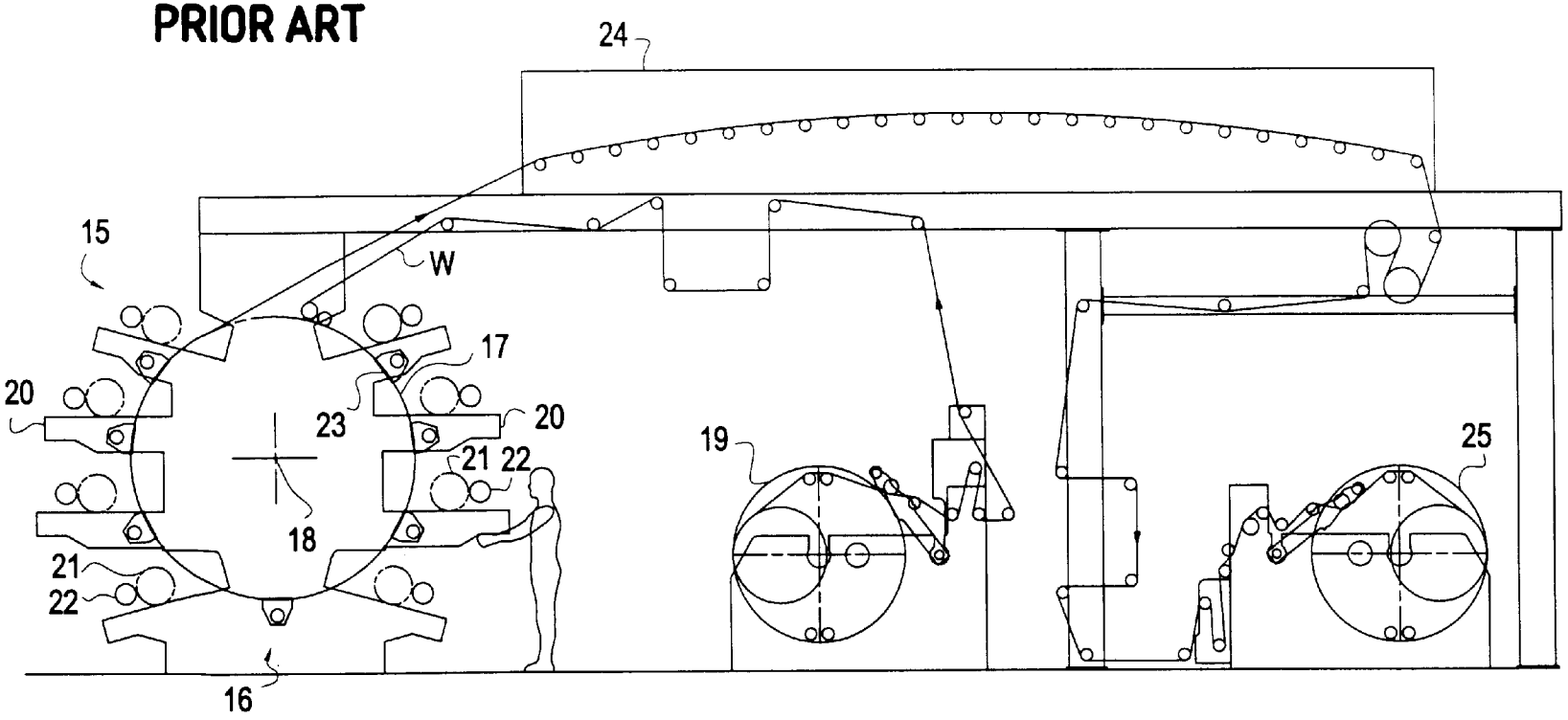
FIG.1 PRIOR ART
FIG. 1 is a front elevational view of a conventional flexographic printing press.

FIG. 1 illustrates a conventional prior art flexographic printing press 15 which includes a front frame 16, a rear frame (not shown), and a central impression (CI) drum or cylinder 17 which is rotatably mounted in the frames for rotation about its central axis 18. A web W is conveyed from an unwind stand 19 to the CI drum and is supported by the drum as the drum rotates.

A plurality of print decks or color decks 20 are mounted on the frames around the periphery of the CI drum 17. Each deck includes a plate roll 21 and an anilox roll 22 which are rotatably mounted on the deck. An ink fountain (not shown) on the deck supplies ink to the anilox roll, and the anilox roll transfers the ink to the plate roll. The plate roll prints an image on the web as the web is moved past the plate roll on the rotating CI drum. Between color dryers 23 are mounted between adjacent color decks, and the fully printed web is conveyed through a tunnel dryer 24 and rewound on rewind stand 25.

Figure 2:
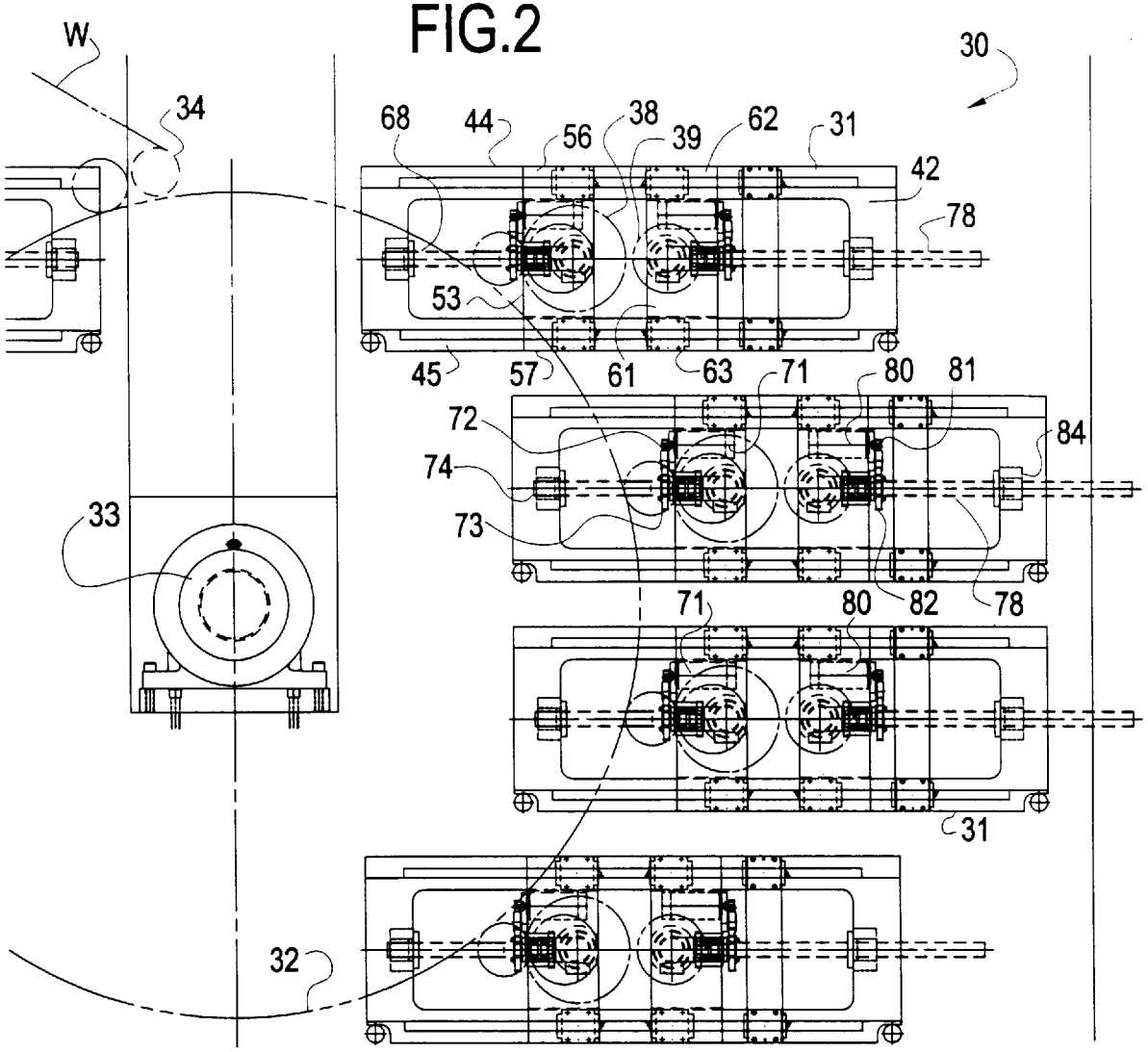
FIGS. 2 and 3 are fragmentary front elevational views of the right and left sides of a flexographic press which is equipped with a sideshift mechanism in accordance with the invention.
Figure 3:
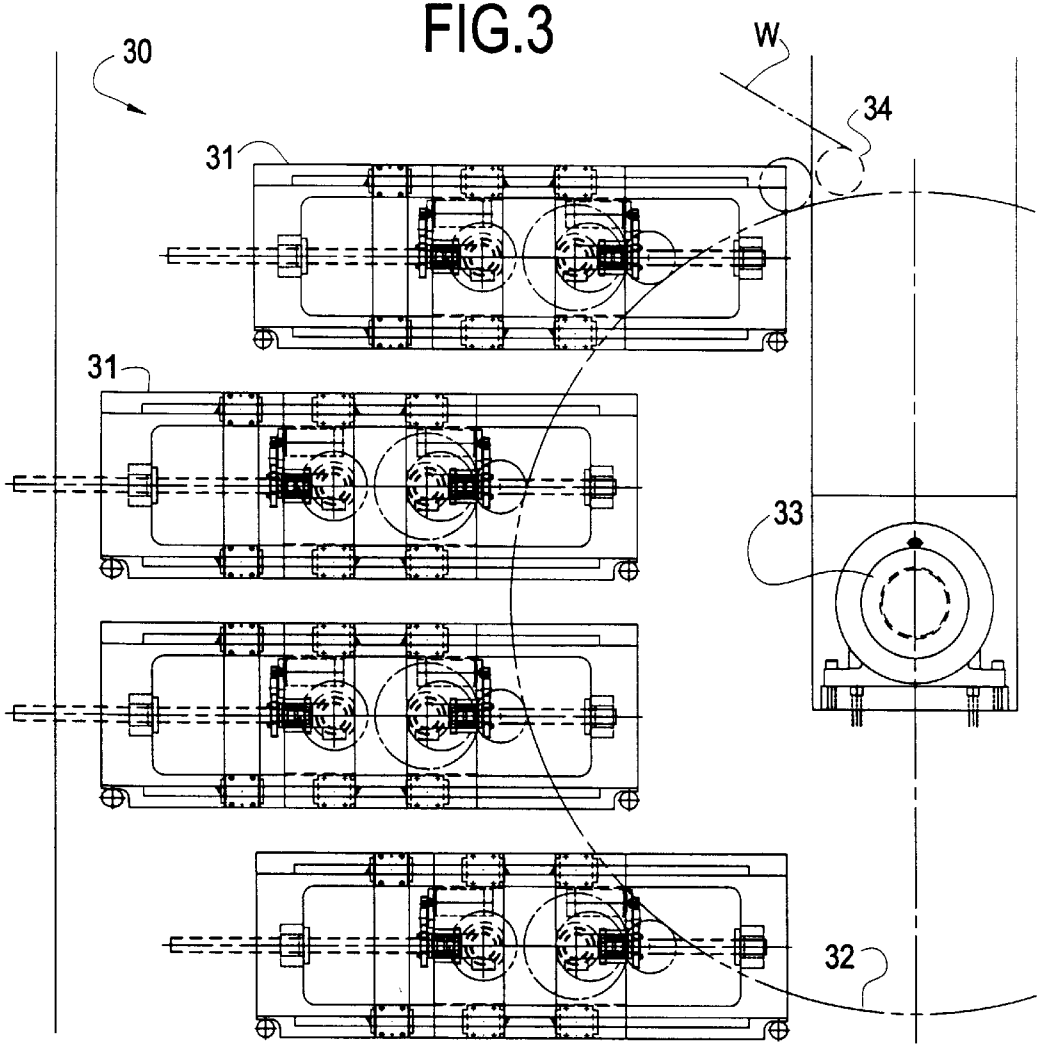

FIGS. 2 and 3 illustrate a flexographic press 30 with color decks 31 which include side shift mechanisms in accordance with the invention. The press 30 includes a conventional CI drum 32 which is rotatably mounted in bearings 33 which are supported on the front and back frames (not shown) of the press. A web W passes over laydown roll 34 an rotates with the CI drum.

Each of the color decks 31 includes a plate roll 38 and an anilox roll 39 which are supported by rectangular bearing support frames 42 which are mounted on the front and back frames of the press. Each bearing support frame 42 includes a pair of parallel spaced-apart upper and lower linear rails 44 and 45.

Figure 4:
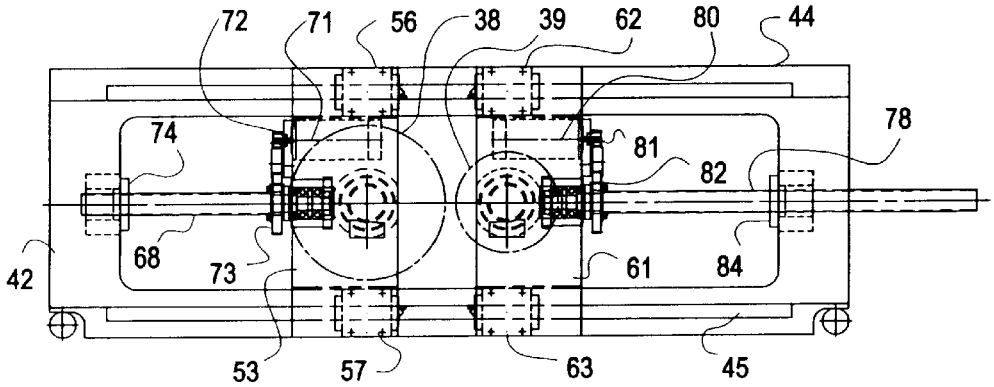
FIG. 4 is a fragmentary front view of one of the press decks of FIG. 2 showing the front carriages for the plate and anilox rolls in their home positions.

The plate and anilox rolls are illustrated in FIGS. 2–4 in their racked out positions in which the plate rolls are spaced from the surface of the CI drum and the anilox rolls are spaced from the plate rolls.

Figure 6:
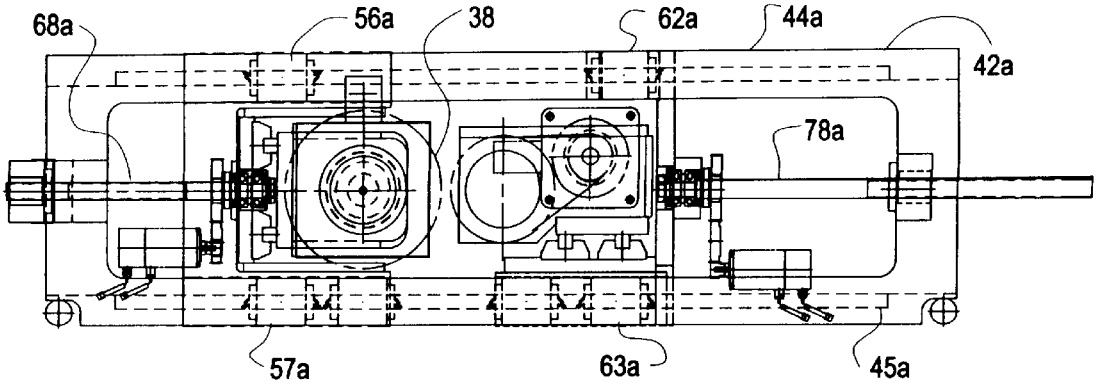
FIG. 6 is a fragmentary back view of one of the press decks showing the back carriages for the plate and anilox rolls.
Figure 7:
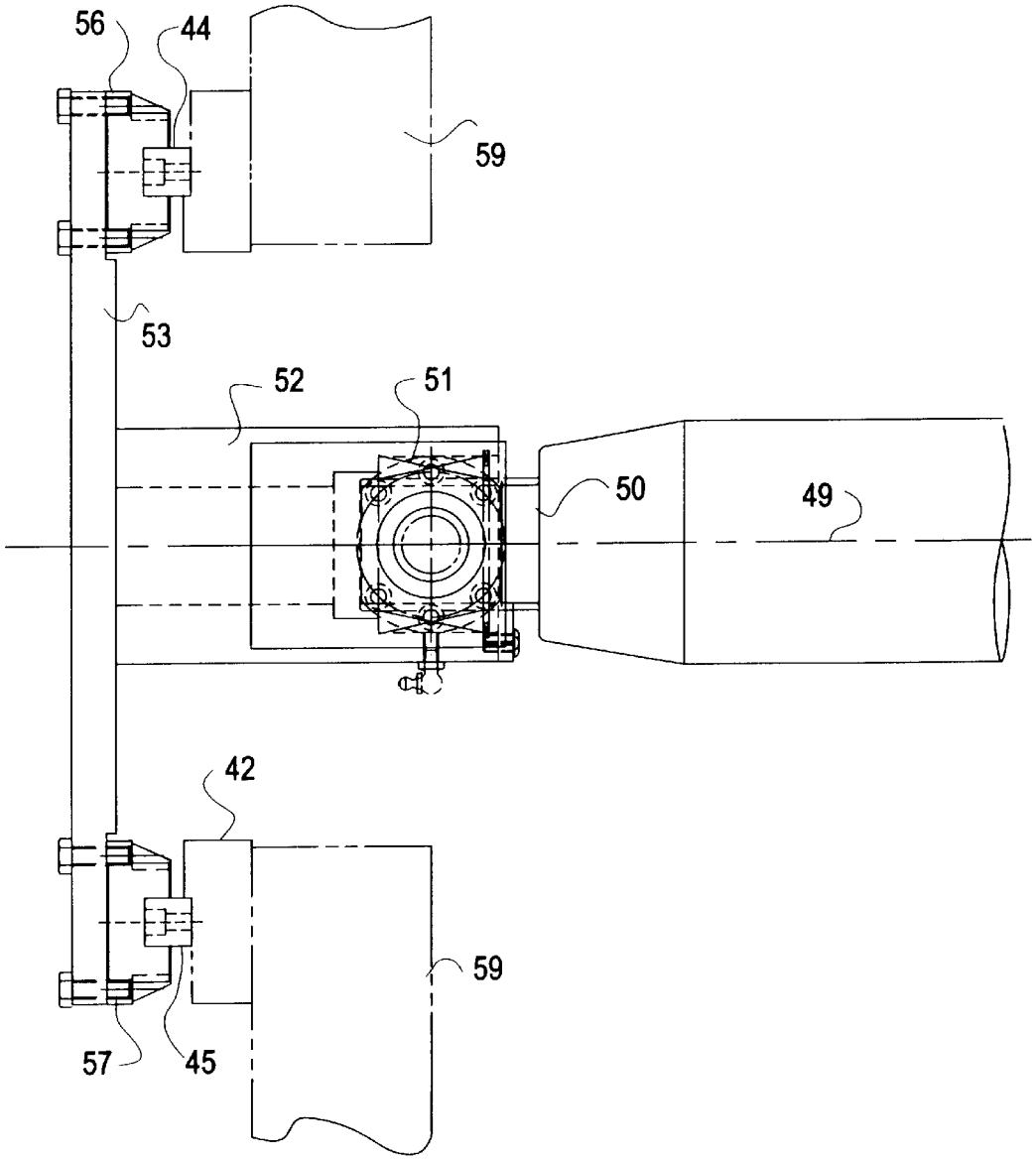
FIG. 7 is a fragmentary left side view of the plate roll of FIG. 4.

Referring to FIG. 7, each plate roll 38 has a longitudinal axis 49 and includes a front end journal 50 which is rotatably supported in a bearing 51. The bearing 51 is mounted in a bearing block 52 which is attached to a front plate carriage 53. Upper and lower linear bearings 56 and 57 are attached to the front plate carriage, and the upper and lower bearings are slidably mounted on the upper and lower linear rails 44 and 45 of the front bearing support frame 42. FIG. 6 illustrates the attachment of the front bearing support frame 42 to the front frame 59 of the press. The axis of the plate roll extends perpendicularly to the upper and lower rails 44 and 45.

The anilox roll 39 is similarly mounted on the upper and lower rails 44 and 45. A front anilox carriage 61 is supported by upper and lower linear bearings 62 and 63. A bearing 64 (FIG. 8) is mounted in a bearing block 65 on the anilox carriage and rotatably supports the front journal 66 of the anilox roll.

The mechanism for moving the plate carriage 53 and the anilox carriage 61 toward and away from the CI drum is described in detail in the co-pending United States patent application entitled Deck Configuration for a Printing press which was filed on even date herewith and which is incorporated herein by reference. Briefly, a ball screw 68 is rotatably mounted on the plate carriage 53 by a bushing 69 (FIGS. 2 and 4). A stepper motor 71 is mounted on the plate carriage and rotates the ball screw through gears 72 and 73. The left end of the ball screw is threaded through a nut 74 which is mounted on the bearing support frame 42. As the ball screw 68 is rotated by the stepper motor 71, the plate carriage 61 is moved along the upper and lower rails 44 and 45.

A second ball screw 78 is similarly rotatably mounted on the anilox carriage 61. A stepper motor 80 rotates the ball screw 78 through gears 81 and 82. The right end of the ball screw is threaded through nut 84 on the bearing support frame 42.

Figure 8:
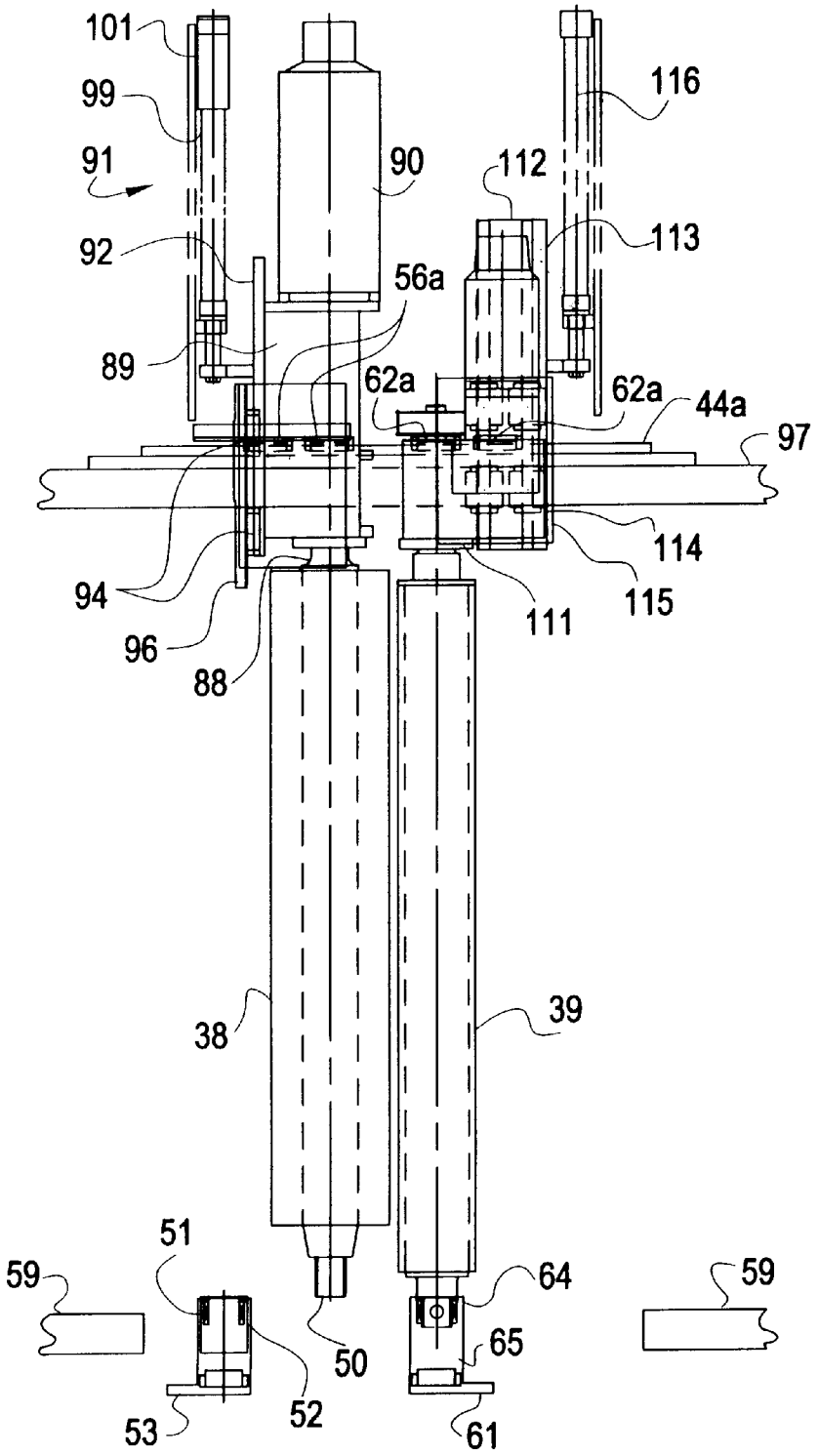
FIG. 8 is a fragmentary top view of the plate and anilox rolls of FIG. 4 showing the plate roll retracted away from the front frame and the front carriage for the plate roll moved out of its supporting position for the plate roll.

Referring to FIG. 8, the back journal 88 of the plate roll 38 is rotatably supported by a bearing in a bearing block 89. The plate roll is driven by a motor 90.

The bearing block 89 is mounted on a side shift mechanism 91 which shifts the bearing block and the plate roll in the axial direction of the plate roll. The bearing block 89 and motor 90 are supported by a bracket 92, and the bracket 92 is slidably mounted by linear bearings 94 on rails 96 which extend parallel to the axis of the plate roll. The rails 96 are supported by the back frame 97.

The bracket 92 and the plate roll can be shifted forwardly and backwardly in directions parallel to the axis of the plate roll by a linear actuator 99. In the embodiment illustrated in FIG. 7, the linear actuator 99 is attached to bracket 92. The linear actuator 99 is mounted on the back frame. A stepper motor 101 is mounted on the linear actuator 99 and moves bracket 92 via the linear actuator 99.

The foregoing side shift mechanism is similar to conventional mechanisms for adjusting print laterally. However, the side shift mechanism of the invention provides greater length of motion and moves more components.

Mechanisms other than linear actuators, for example, air cylinders, can also be used to shift the plate roll axially.

If desired, the back bearing block 89 and the bracket 92 can be slidably mounted on a rectangular frame 42*a* (FIG. 6) like the frame 42 on which the front plate carriage 53 is mounted. The bracket 92 can be slidably mounted on the upper and lower rails 44*a* and 45*a* of the frame 42*a* by linear bearings 56*a* and 57*a*. The plate roll can then be moved toward and away from the CI drum by the ball screw 68*a* as described in the aforementioned patent application entitled Deck Configuration For A Printing Press.

FIG. 8 illustrates the position of the plate roll 38 after the plate roll has been retracted away from the front frame 59 by the linear actuator 99 of the side shift mechanism. The front journal 50 of the plate roll has been withdrawn from the front bearing 51, and the front plate carriage 53 has been moved to the left along the rails 44 and 45 (see also FIG. 5) by the ball screw 68. The back end of the plate roll is cantilevered by the back bearing block 89.

Figure 9:
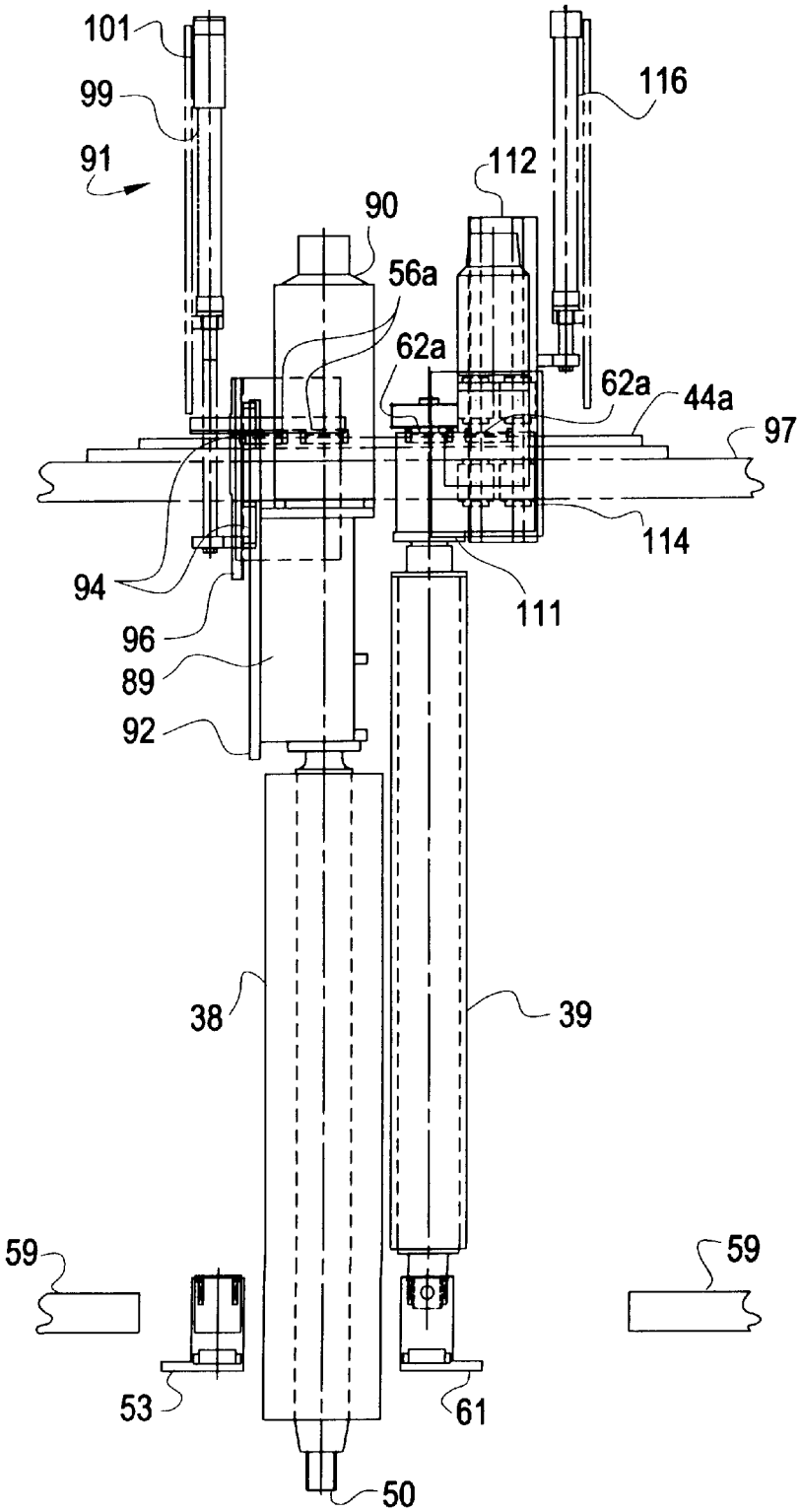
FIG. 9 is a view similar to FIG. 8 showing the plate roll extended forwardly so that the front end thereof extends out of the front frame.

FIG. 9 illustrates the plate roll 38 in an extended position in which the front journal 50 and the front end of the print surface extend beyond the front frame 59. The plate roll is now positioned so that the plate roll or the sleeve of the plate roll can be easily grasped and withdrawn from the press.

Figure 10:
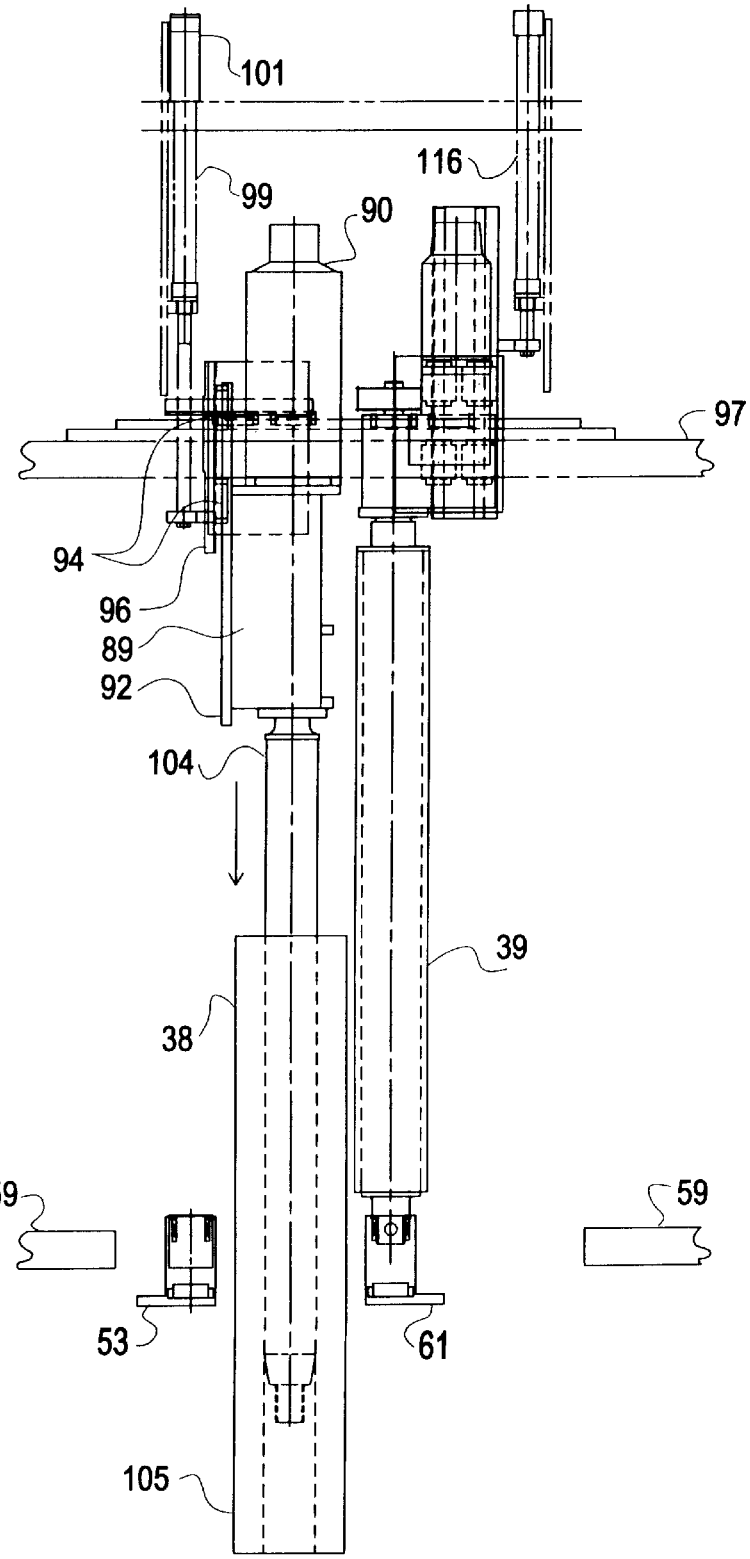
FIG. 10 is a view similar to FIG. 9 showing the sleeve of the plate roll being removed from the mandrel of the plate roll.

In FIG. 10 the plate roll 38 includes a mandrel 104 and a sleeve 105. The sleeve 105 is being withdrawn from the mandrel while the mandrel remains cantilevered in the back bearing block 89. The operator can apply air pressure to the mandrel so that air flows between the mandrel and the sleeve to facilitate removal of the sleeve.

A new sleeve can be easily inserted over the end of the mandrel which extends from the front frame. The extended mandrel guides the new sleeve into the press.

After the sleeve is replaced, the side shift mechanism returns the plate roll to the retracted position of FIG. 8. The front plate carriage 53 is moved into alignment with the plate roll by the ball screw 68. The plate roll is then shifted forwardly by the side shift mechanism until the front journal 50 is inserted into the bearing 51.

The anilox roll 39 can be shifted axially by a similar side shift mechanism 110 (FIG. 8). The back journal of the anilox roll is supported by a bearing in a bearing housing 111, and the anilox roll is driven by a motor 112. The bearing housing and motor are mounted on a bracket 113 which is slidably mounted by linear bearings 114 on rails 115. The rails 115 may also be slidably mounted on the linear rails 44*a* and 45*a* (FIG. 6) on the back frame by linear bearings 62*a* and 63*a* if it is desired to move the anilox roll toward and away from the plate roll by the ball screw 78*a*. A linear actuator, e.g., a linear actuator 116, moves the bracket 113 and the anilox roll in the axial direction of the anilox roll.

The anilox roll or a sleeve of the anilox can be changed in the same way as the plate roll. The linear actuator 116 first shifts the anilox roll axially away from the front anilox carriage 61 to withdraw the front journal 66 from the bearing 64. The anilox carriage 61 is then moved to the right by ball screw 78 as illustrated in FIG. 5.

Figure 5:
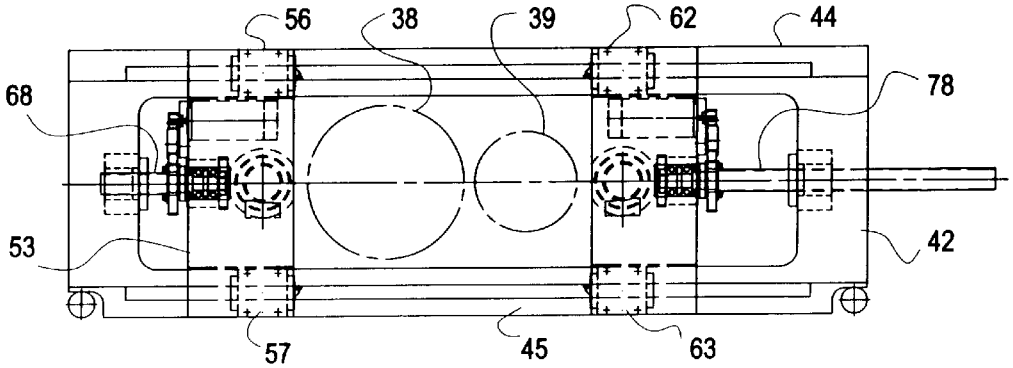
FIG. 5 is a view similar to FIG. 4 showing the front carriages for the plate and anilox rolls in their sleeve exchange positions.

FIG. 5 illustrates both the plate carriage 53 and the anilox carriage 61 moved out of alignment with the associated plate roll or anilox roll.

After the anilox carriage is moved out of alignment with the anilox roll, the linear actuator 116 moves the anilox roll forwardly so that the front end thereof extends from the front frame 59. The anilox roll or the sleeve of the anilox roll can then be easily removed and replaced. Thereafter, the anilox roll is retracted, the anilox roll is returned to the position of FIG. 4, and the anilox roll is extended to reseat the front journal 66 in the bearing 64.

Figure 11:
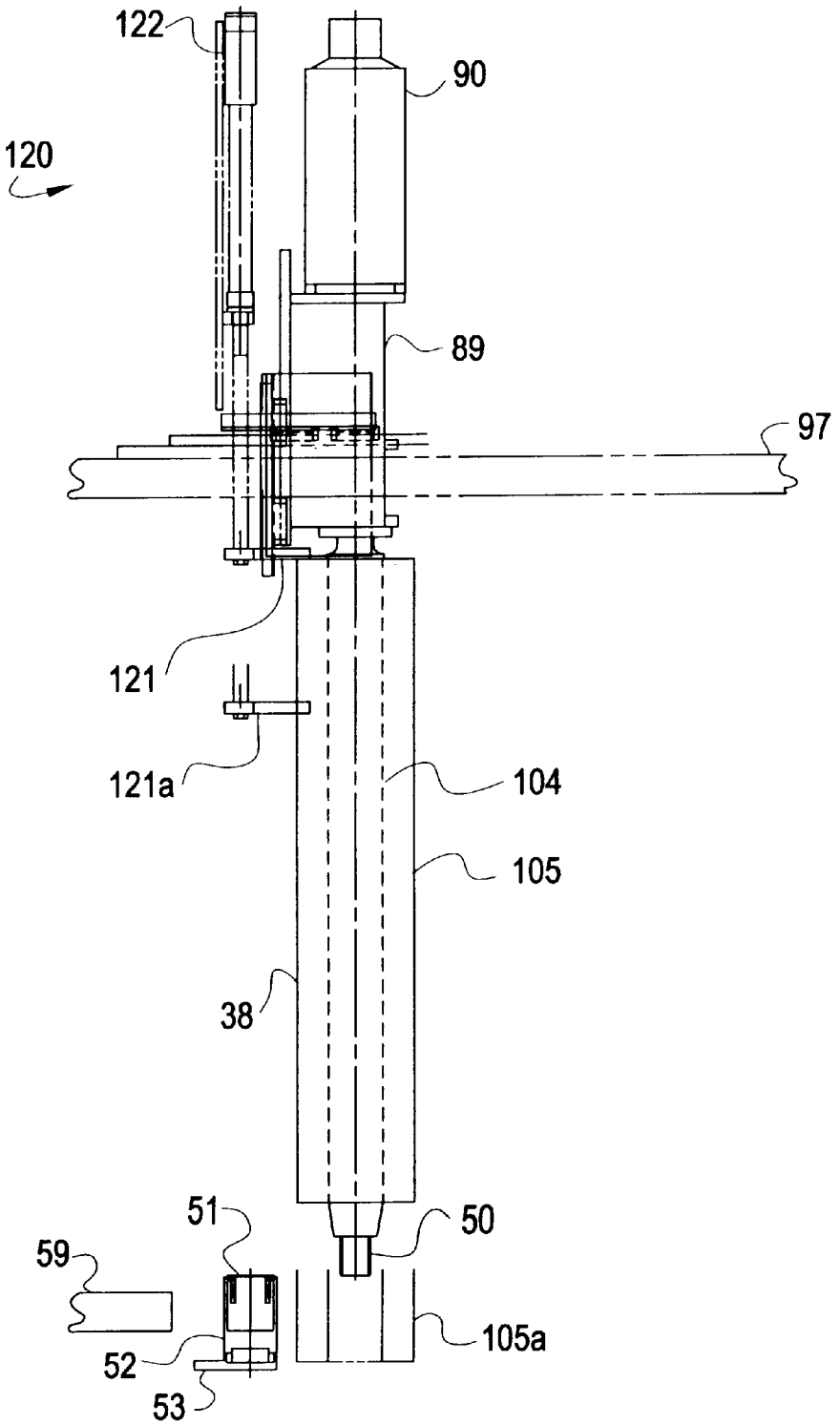
FIG. 11 illustrates an alternate embodiment of the invention which includes a pusher for pushing the sleeve of the plate roll off of the mandrel of the plate roll.

FIG. 11 illustrates another embodiment of a side shift mechanism 120 for the plate roll 38. The side shift mechanism 120 is similar to the side shift mechanism 91 and like parts are identified by like reference numerals. However, the mechanism 120 includes a pusher 121 which is axially slidably mounted on bracket 92. The pusher can be moved axially by a linear actuator 122 which is mounted on the bracket. The motor 90 remains stationary while the pusher 121 moves.

After the front journal 50 of the plate roll is retracted from the front bearing 51 and the plate carriage 53 is moved to the left as shown in FIG. 11, the pusher 121 is moved axially forwardly to move the sleeve 105 relative to the mandrel 104 as illustrated in phantom at 121*a* and 105*a*. The sleeve can then be easily grasped by the operator and removed from the mandrel. The pusher 121 is retracted before a new sleeve is inserted on the mandrel.

A similar pusher can be used to push the sleeve of the anilox roll relative to the mandrel of the anilox roll.

Figure 12:
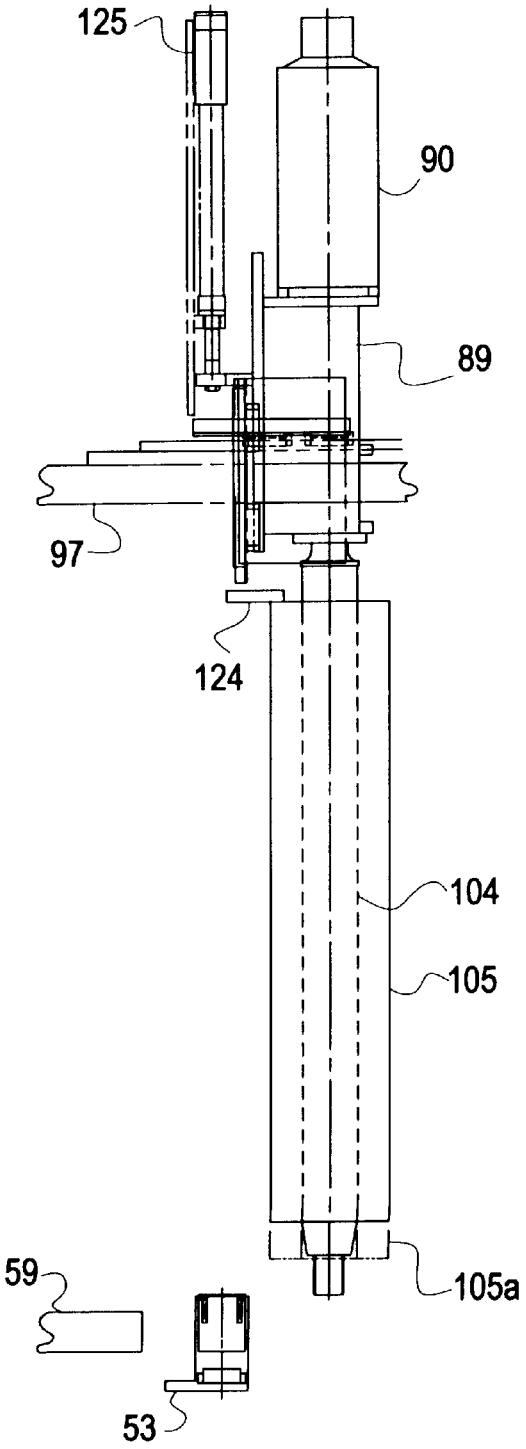
FIG. 12 illustrates another embodiment of a pusher for pushing the sleeve of the plate roll off of the mandrel.

FIG. 12 illustrates another embodiment of a pusher for removing the sleeve 105 from the mandrel 104,. A stationary pusher 124 is mounted on the back frame 97 adjacent the back end of the sleeve 105. After the front journal of the roll is removed from the front bearing, a linear actuator 125 pulls the mandrel 104 and motor 90 rearwardly. The sleeve 105 is held in place by the stationary pusher 124 and extends forwardly from its operating position on the mandrel as illustrated at 105*a*. The actuator 125 then moves the plate roll assembly forwardly so that the forward end of the sleeve extends beyond the front frame 59.

The mandrel and sleeve components of the plate and anilox rolls are similar to those used on the prior art Vision II Flexographic printing press of Paper Converting Machine Company of Green Bay, Wis., the assignee of this invention. Sleeves for flexographic presses are commercially available from Rotec, Rossini, and others. The linear guide components are commercially available from THK, SKF, and Star Linear.

While in the foregoing specification a detailed description of specific embodiments of the invention has been set forth for the purpose of illustration, it will be understood that many of the details hereingiven can be varied considerably by those skilled in the art without departing from the spirit and scope of the invention.

We claim:

1. A printing press comprising:

front and back frames, a front bearing supported on the front frame, a back bearing supported on the back frame, an elongated roll extending axially between the front and back frames, the roll having front and back ends which are rotatably supported by the front and back bearings, a linear guide mounted on the back frame and extending axially relative to the roll, the linear guide supporting the back bearing for movement in the axial direction of the roll, the front bearing being movably mounted on the front frame between a first position in which the front bearing rotatably supports the front end of the roll and a second position in which the front bearing does not support the front end of the roll, and means for moving the back bearing and the roll in the axial direction of the roll.

2. The press of claim 1 including a second linear guide mounted on the front frame and extending perpendicularly to the axis of the roll, the second linear guide supporting the front bearing for movement between said first and second positions in a direction which is perpendicular to the axis of the roll whereby the means for moving the back bearing and the roll can move the back bearing and the roll away from the front bearing so that the front end of the roll is not supported by the front bearing and the front bearing can thereafter move to its second position.

3. The press of claim 1 in which the means for moving the back bearing and the roll includes a screw for causing relative movement between the back bearing and the back frame.

4. The press of claim 3 in which the means for moving the back bearing and the roll includes a stepper motor for rotating the screw.

5. The press of claim 1 in which the means for moving the back bearing and the roll includes an air cylinder.

6. A printing press comprising:

front and back frames, a central impression cylinder having an axis and which is rotatably mounted in the front and back frames, a first linear guide mounted on the front frame and extending perpendicularly to the axis of the central impression cylinder, a front bearing slidably mounted on the first linear guide in a direction which is perpendicular to the axis of the central impression cylinder, a back bearing mounted on the back frame, a roll having an axis which extends parallel to the axis of the central impression cylinder, the roll having front and back ends which are rotatably supported by the front and back bearings, a second linear guide mounted on the back frame and extending axially relative to the roll, the second linear guide supporting the back bearing for movement in the axial direction of the roll, the front bearing being movable on the first linear guide between a first position in which the front bearing rotatably supports the front end of the roll and a second position in which the front bearing does not support the front end of the roll, and means for moving the back bearing and the roll in the axial direction of the roll.

7. The press of claim 6 in which the means for moving the back bearing and the roll includes a screw for causing relative movement between the back bearing and the back frame and a stepper motor for rotating the screw.

8. The press of claim 7 including a second screw extending between the front bearing and the front frame in a direction which extends parallel to the first linear guide and a second stepper motor for rotating the second screw whereby rotation of the second screw moves the front bearing on the first linear guide.

9. The press of claim 6 in which the means for moving the back bearing an the roll includes an air cylinder for causing relative movement between the back bearing and the back frame.

10. A method of changing a sleeve on a printing press roll which is rotatably mounted in front and back bearings which are mounted on front and back frames of a printing press, the roll including a mandrel and a sleeve on the mandrel, the sleeve having front and back ends which are adjacent the front and back bearings, comprising the steps of:

moving the roll in an axial direction away from the front bearing, moving the front bearing out of axial alignment with the roll, moving the sleeve in an axial direction toward the front frame so that front end of the sleeve extends through the front frame, and removing the sleeve from the mandrel by pulling the front end of the sleeve.

11. The method of claim 10 in which the front bearing is slidably mounted on the front frame for sliding movement in a direction which is perpendicular to the axis of the roll, said step of moving the front bearing out of alignment with the roll comprising sliding the front bearing away from the axis of the roll.

12. The method of claim 10 in which said step of moving the sleeve in an axial direction toward the front frame includes moving the mandrel with the sleeve.

13. The method of claim 10 in which said step of moving the sleeve in an axial direction toward the front frame is performed by pushing the sleeve forwardly relative to the mandrel.

14. A method of changing a sleeve on a printing press roll which is rotatably mounted in front and back bearings which are mounted on front and back frames of a printing press, the roll including a mandrel and a sleeve on the mandrel, the sleeve having front and back ends which are adjacent the front and back bearings, comprising the steps of:

moving the roll in an axial direction away from the front bearing, moving the front bearing out of axial alignment with the roll, moving the mandrel in an axial direction toward the back frame while preventing axial movement of the sleeve so that the mandrel moves backwardly relative to the sleeve, moving the roll and the sleeve in an axial direction toward the front frame so that front end of the sleeve extends through the front frame, and removing the sleeve from the roll by pulling the front end of the sleeve.

15. The method of claim 14 in which said step of preventing axial movement of the sleeve is performed by engaging a stationary pusher with the sleeve but not the mandrel.

* * * * *

UNITED STATES PATENT AND TRADEMARK OFFICE

CERTIFICATE OF CORRECTION

PATENT NO. : 6,142,073
DATED : November 7, 2000
INVENTOR(S) : Dale E. Zeman et al.

It is certified that error appears in the above-identified patent and that said Letters Patent is hereby corrected as shown below:

Title page,
Item [73], Assignee, should be -- Paper Converting Machine Company --.

Signed and Sealed this

Eighteenth Day of October, 2005

JON W. DUDAS
*Director of the United States Patent and Trademark Office*